US006305200B1

(12) United States Patent
Moen

(10) Patent No.: US 6,305,200 B1
(45) **Date of Patent: *Oct. 23, 2001**

(54) KEYWAY PLUG

(76) Inventor: Richard C. Moen, P.O. Box 1911, Brewster, MA (US) 02631

( * ) Notice: Subject to any disclaimer, the term of this patent is extended or adjusted under 35 U.S.C. 154(b) by 0 days.

This patent is subject to a terminal disclaimer.

(21) Appl. No.: 09/395,701

(22) Filed: Sep. 14, 1999

Related U.S. Application Data

(63) Continuation-in-part of application No. 08/989,721, filed on Dec. 12, 1997, now Pat. No. 5,950,466.

(51) Int. Cl.[7] ..... E05B 17/14
(52) U.S. Cl. ..... 70/428; 70/395; 70/398
(58) Field of Search ..... 70/395, 398, 423–430

(56) References Cited

U.S. PATENT DOCUMENTS

| | | | |
|---|---|---|---|
| 1,696,326 | 12/1928 | Roethlisberger . | |
| 1,728,310 | 9/1929 | Sundel . | |
| 1,807,540 | 5/1931 | Makranczy . | |
| 2,068,936 | 1/1937 | Unterberg . | |
| 2,591,652 | 4/1952 | Ziegliss . | |
| 2,662,390 | 12/1953 | Michnoff et al. . | |
| 3,276,233 | 10/1966 | Russel et al. . | |
| 3,408,842 | 11/1968 | Barnes et al. . | |
| 4,120,184 | 10/1978 | Gerlach . | |
| 5,950,466 * | 9/1999 | Moen | 70/428 |

FOREIGN PATENT DOCUMENTS

| | | |
|---|---|---|
| 289878 | 9/1966 | (AU) . |
| 52-15799 | 5/1977 | (JP) . |

* cited by examiner

*Primary Examiner*—Suzanne Dino Barrett
(74) *Attorney, Agent, or Firm*—Morse, Altman & Martin

(57) ABSTRACT

A keyway plug that provides a means for preventing the correct key from opening a tumbler lock, including a plug and an extractor. The plug fits into the keyway to block complete insertion of a key. An arm extends from the tip of the plug across the tumblers, but is short enough so that the outermost tumbler drops to hide the plug. The extractor includes a narrow finger, the end of which pushes the innermost part of the plug upwardly, while the tumblers push the outermost part of the plug downwardly. A chamfer at the outer end of the plug arm pushes the outermost tumbler up out of the way so the plug can be removed. The upper edge of the finger includes a hook that mates with a matching notch in the lower edge of the plug arm. As the extractor is removed, the hooks and notch interlock, pulling the plug from the keyway.

5 Claims, 3 Drawing Sheets

KEYWAY PLUG

RELATED APPLICATIONS

The present application is a continuation-in-part application of application Ser. No. 08/989,721, dated Dec. 12, 1997, and now U.S. Pat. No. 5,950,466, for KEYWAY PLUG in the name of Richard C. Moen.

BACKGROUND OF THE INVENTION

1. Field of the Invention

The present invention relates to tumbler locks, more particularly, to a device for preventing a key from being inserted into a tumbler lock.

2. The Prior Art

Tumbler locks have a variety of uses, the most prevalent being as building door locks and as automotive ignition and door locks. There are occasions when it is desired to prevent a tumbler lock from being opened, even by the correct key. For example, a worker is given a key to a room that is only to be used during normal business hours. Or a person is loaned a car, but is told not to open the trunk. Or a person renting a locker is behind in his/her rental payments. In all cases, the key will be able to open the lock at any time, but for some reason, the person in possession of the key is to be prevented from doing so. A number of devices have been developed over the years to prevent the correct key from opening a lock, for example, U.S. Pat. No. 1,696,326 issued to Roethlisberger, U.S. Pat. No. 1,728,310 issued to Sundel, U.S. Pat. No. 2,068,936 issued to Unterberg, and U.S. Pat. No. 3,408,842 issued to Barnes et al. The common element of these disclosures is a plug that is inserted into the keyway that prevents any key from being completely inserted.

The plug of Roethlisberger fits into the keyway so that the outer tumblers return to rest on the lower arm of the plug, in front of the upper extension, blocking the plug from being removed. The major shortcoming of this design is that the plug must be long enough so that all of the tumblers drop onto the lower arm. If the arm is too short, the outermost tumblers will drop below the arm, to their normal locked position. If this should happen, the plug cannot be removed, even by the mating extractor, because the extractor cannot be inserted past the outermost tumbler. Another related shortcoming is that the inner end of the keyway must be at least partially closed so that the plug cannot be pushed too far and preventing the outermost tumbler from dropping as describe above.

The plug of Sundel solves the problems of Roethlisberger with an external plate that prevents the plug from being inserted too far into the keyway. However, unlike Roethlisberger, when the plug of Sundel is installed, it is very visible because to the external nature of the plate. Also, the external plate gives a person attempting to remove the plug a point of leverage, which may result in destruction of the lock.

The plug of Unterberg also attempts to solve the problem of being pushed to far into the keyway by using a notch in the upper surface of the plug that the innermost tumbler can fall into. However, because the notch must pass all of the other tumblers, it must be sloped on both sides. So it is still possible for the plug to be pushed too far into the keyway. Unterberg also uses a small external hook that prevents the plug from being inserted too far. However, the hook, like the external plate of Sundel, makes the plug more visible and gives a person leverage in an attempt to remove the plug, which would be relatively easy to do, since there is nothing holding the plug firmly in the keyway.

Unterberg and the plug of Barnes also have the problem that they, like Roethlisberger, must be long enough to extend over all of the tumblers. If the outermost tumbler should drop in front of the plug, the plug could not be removed. The flat end of the upper arm of the plug would be caught against the tumbler and the flat end of the extractor could not be inserted past the tumbler.

SUMMARY OF THE INVENTION

An object of the present invention is to provide a keyway plug for preventing the correct key from opening a tumbler lock.

Another object is to provide a keyway plug that is hidden from casual inspection behind the outermost tumbler in the keyway.

The keyway plug of the present invention provides a means for preventing the correct key from opening a tumbler lock, while overcoming the deficiencies of the prior art. It includes a plug and an extractor. The plug fits into the keyway to block entrance of a key. Its tip is similar to the tip of an ordinary key. An arm extends from the tip along the keyway. Unlike the plugs of the prior art, the arm of the first embodiment of the plug does not have to extend across all of the tumblers. The arm is short enough that the outermost tumbler drops behind the plug, and the height of the arm is less then the height of the tumbler, hiding the plug from casual inspection.

An extractor is used to remove the plug from the keyway. The extractor includes a narrow finger, the upper edge of which includes a hook that mates with a matching hook in the lower edge of the plug arm.

To overcome the problem of the prior art plugs where the outermost tumbler prevents the plug from being removed with the extractor, the innermost part of the lower edge of the arm forms a shaped cutout that slopes downwardly toward the plug tip. The inner end of the extractor finger has a level upper edge. As the extractor is being inserted into the keyway, the end of the extractor forces the plug tip upwardly against the innermost tumblers. The plug will move upwardly because of the play between the keyway and plug. As the plug tip moves upwardly, the central tumblers push down on the plug arm, causing the outer end of the arm to tip downwardly below the level of the outermost tumbler. The outer end of the arm has a chamfer to push the outermost tumbler up out of the way as the plug is being extracted. When the extractor and plug hooks become aligned, the tumblers push the plug back down against the extractor, and when the extractor is pulled from the keyway, the hooks mate to pull the plug from the keyway.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

The keyway plug of the present invention provides a means for preventing the correct key from opening a tumbler lock. There are several different types of tumbler locks, including pin tumblers, disc tumblers, and sidebar tumblers. The figures of the present disclosure show the present invention in operation with a pin tumbler lock. However, these figures are intended to be illustrative only, and it is contemplated that the present invention will be used with any type of tumbler lock available.

Figure 1:
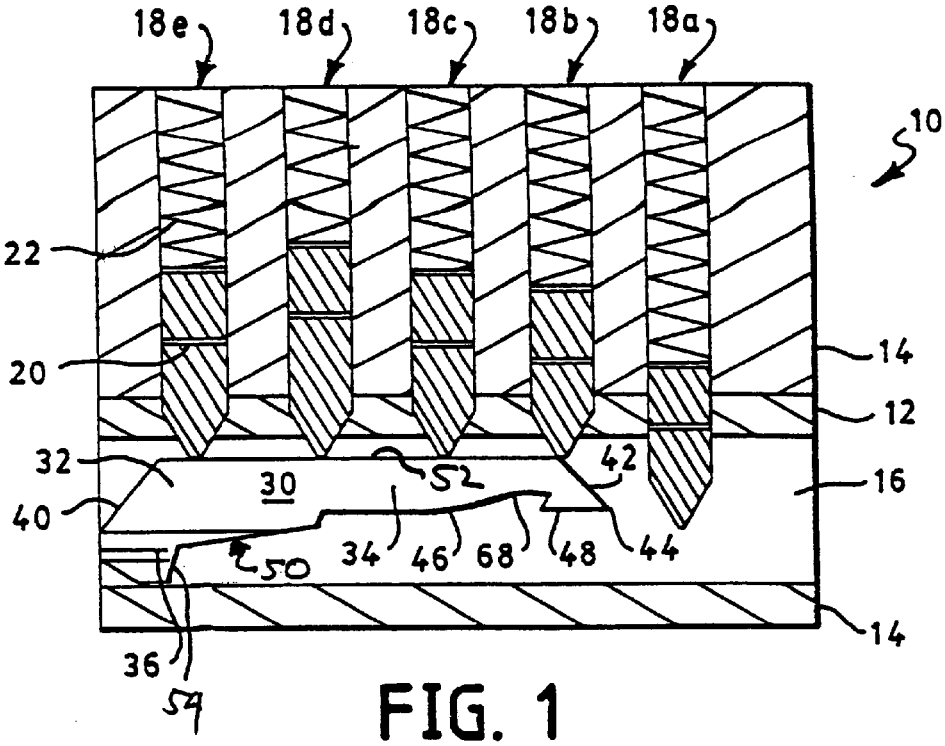
FIG. 1 shows a cross-sectional side view of the pin tumbler lock with the plug of the present invention installed.

FIG. 1 illustrates a typical tumbler lock 10, here a pin tumbler lock, with which the present invention will be used. The lock 10 includes a cylindrical barrel 12 that rotates within a shell 14, a keyway 16, and a series of pin tumblers 18*a*–18*e*. When the correct key (not shown) is inserted into the keyway 16, the pin tumblers 18*a*–18*e* are arranged so that the shear line 20 of all the tumblers 18*a*–18*e* are aligned, permitting the barrel 12 to rotate. Disc tumblers and sidebar tumblers operating in a slightly different manner, but all rely on the correct key aligning the tumblers to permit the barrel to rotate. When no key is inserted, a spring 22 biases the tumbler 18 into the keyway 16.

Figure 2:
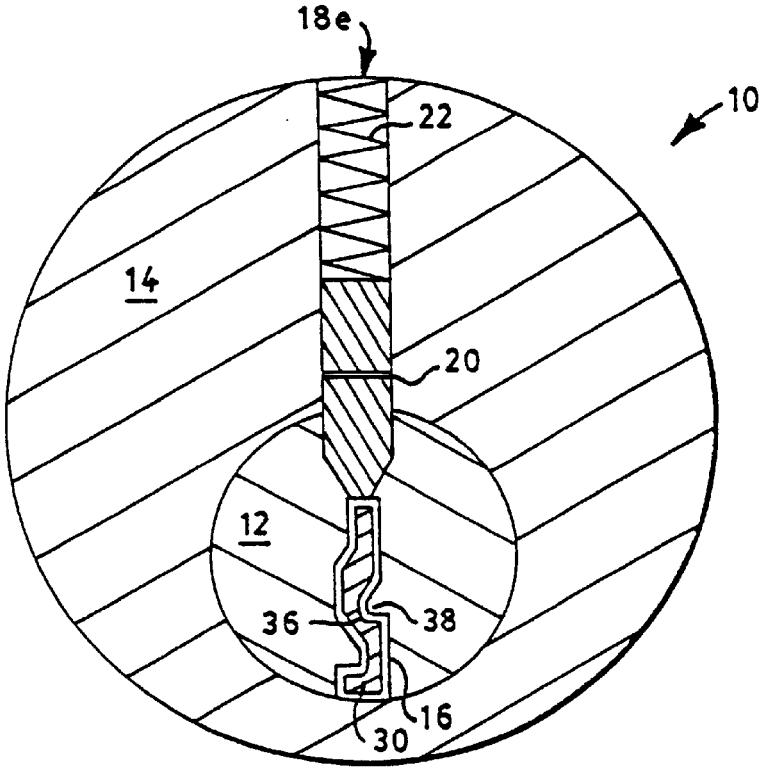
FIG. 2 shows a cross-sectional end view of the plug and keyway of FIG. 1.

The keyway plug of the present invention has at least two components, a plug 30 and an extractor 70. The purpose of the plug 30 is to prevent the key from being completely inserted into the keyway, keeping the tumblers misaligned. As seen in FIG. 1, the plug 30 comprises a tip 32 and an arm 34. The end profile of the lock 10 and plug 30, shown in FIG. 2, shows that the plug 30 has grooves 36 to match ridges 38 in the profile of the keyway 16. The tip 32 has the same height as an ordinary key so that it can be inserted into the keyway 16 without having to jiggle it up and down to find the grooves 36. The tip 32 is similar to the tip of an ordinary key. It includes an upper chamfer 40 that pushes the tumblers 18 up and out of the way when the plug 30 is inserted into the keyway 16.

The plug arm 34 extends away from the top of the tip 32 along the direction of the keyway 16. Unlike the plugs of the prior art, the arm 34 does not have to extend over all of the tumblers 18*a*–18*e*. The arm 34 is short enough that, when the plug 30 is installed in the keyway 16 so that the upper edge 52 of the arm 34 is in contact with most of the tumblers 18, the outermost tumbler 18*a* drops fully into the keyway 16 in front of the plug 30. The height of the arm 34 is slightly less than the distance that the tumbler 18*a* extends into the keyway 16 so that when the plug 30 is installed in the keyway 16, it is hidden from casual inspection and prevented from being easily removed.

Figure 3:
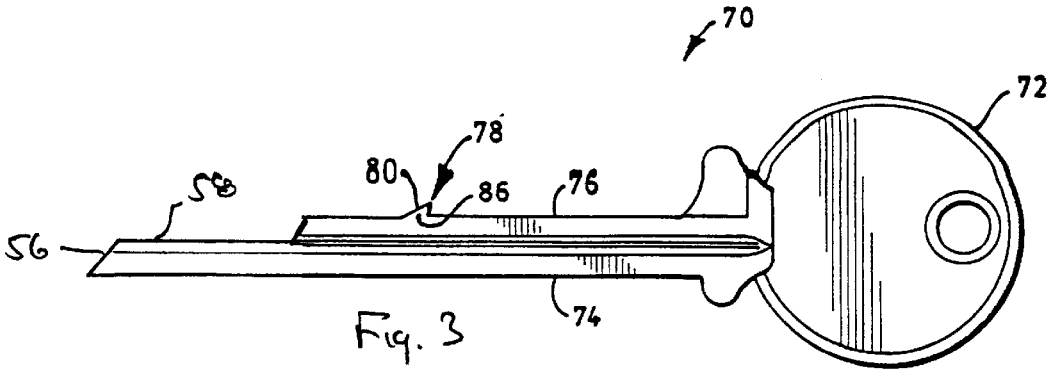
FIG. 3 shows a side view of an extractor.
Figure 4:
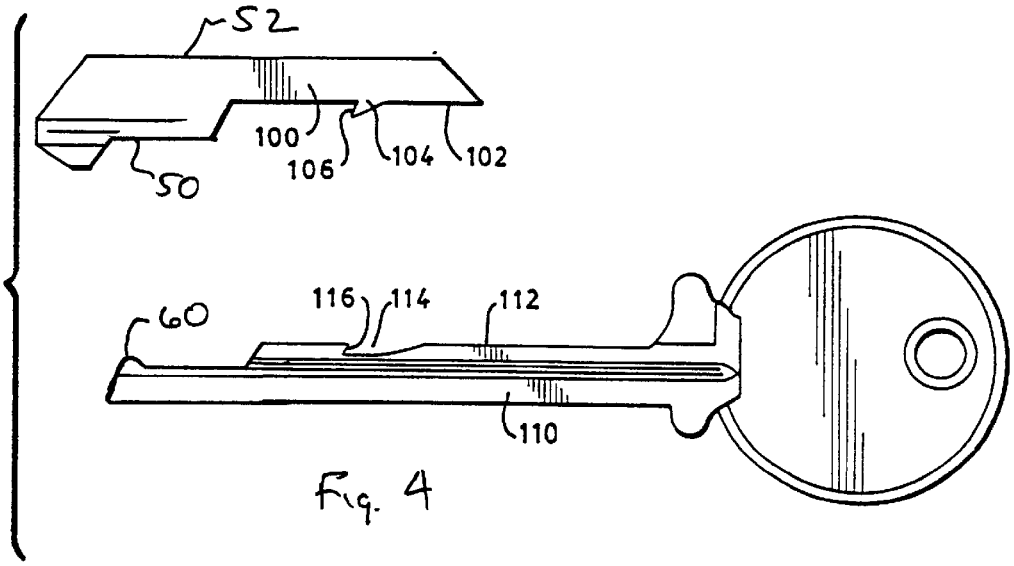
FIG. 4 shows a side view of alternate embodiments of different aspects of the plug and extractor.

The plug 30 is removed from the keyway 16 by an extractor 70, shown in FIG. 3. The extractor 70 includes a head 72 for grasping, like that of a regular key. A long finger 74 extends from the head 72. The upper edge 76 of the finger 74 includes a hook 78 that mates with a matching hook 48 in the lower edge 46 of the plug arm 34. In the embodiment of FIGS. 1 and 3, the plug hook 48 is a formed by a shaped notch 68 in the plug arm 34 and the extractor hook 78 is formed by a shaped protrusion from the upper edge 76 of the finger 74. Alternatively, FIG. 4 shows an arrangement in which the plug hook 106 is formed by a shaped protrusion 104 from the lower edge 102 of the arm 100, and the extractor hook 116 is formed by a shaped notch 114 in the upper edge 112 of the extractor finger 110.

Figure 7:
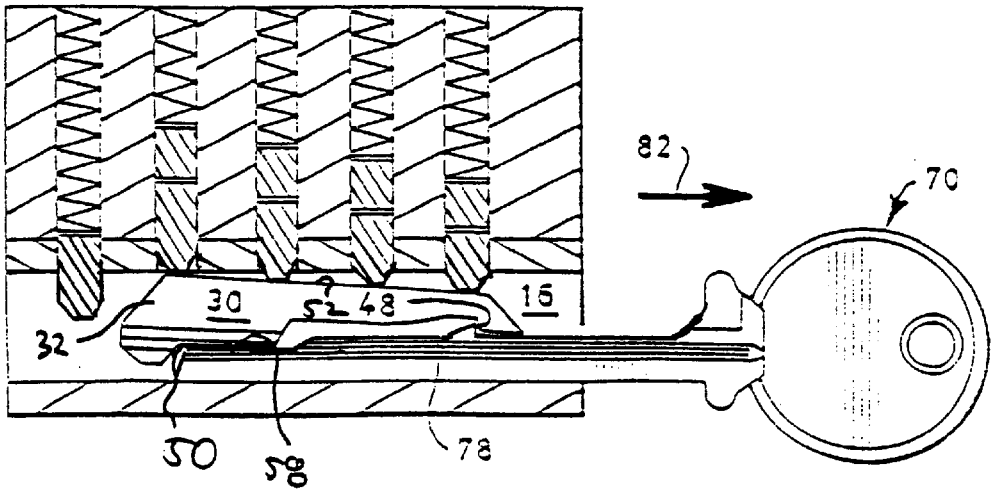
FIG. 7 shows a cross-sectional side view of the end of the extraction procedure.

In order to overcome the problem of the prior art plugs where the outermost tumbler prevents the plug from being removed with the extractor, the inner portion 50 of the lower edge 46 of the plug arm 34 is sloped downwardly so that the height of the inner end 54 of the inner portion 50 is less than the height of the end 56 of the extractor 70. The plug 30 is removed by inserting the extractor 70 into the keyway 16 and pushing it against the plug 30, as at 84. As the extractor 70 continues to be pushed farther into the keyway 16, the extractor end 56 contacts the inner portion 50 and a lifting portion 58 of the upper edge 76 of the finger 74 pushes the plug tip 32 up against the innermost tumblers 18*d*–*e*, as in FIG. 7. If the lifting portion 58 is substantially straight, the inner portion 50 will adjust to conform to the straight end 58 of the finger 74, effectively pushing the plug tip 32 upwardly, as in FIG. 7. Alternatively, as in FIG. 4, the inner portion 50 may be approximately parallel to the upper edge 52 and the end of the finger 74 may slope upwardly or have a protrusion 60, leading to the same result.

The plug 30 moves upwardly because there is play between the keyway 16 and plug 30. As shown in the profile of FIG. 2, there are matching pair of grooves 36 and ridges 38 between the plug 30 and keyway 16. However, because these pairs are loosely fit, the plug 30 can move vertically a small amount relative to the keyway 16. Consequently, the height of the sum of the extractor end 56 and the plug arm 34 above the inner portion 50 must not be greater than the height of the keyway 16. If necessary, a looser fit can be provided by extra-wide grooves 36 on the plug 30.

While the extractor 70 is being inserted, the central tumblers 18*b*–*c* are pushing downwardly against the outer end of the plug arm 34. The combination of the upward pressure of the extractor 70 at the plug tip 32 and the downward pressure of the central tumblers 18*b*–*c* on the arm 34 causes the outer tip 44 of the arm 34 to dip downwardly below the height of the outermost tumbler 18a. Then, as the plug 30 is being pulled from the keyway 16, as at 82, a chamfer 42 at the end of the arm 34 pushes the outermost tumbler 18*a* up and out of the way.

At the same time, the downward pressure of the central tumblers 18*b*–*c* push either the notch 68 of FIG. 1 onto the protrusion 78 of FIG. 3 or protrusion 106 of FIG. 4 into the notch 114. When the extractor 70 is pulled from the keyway 30, as at 82, the hooks mate, pulling the plug 30 from the keyway 16, as in FIG. 7.

Figure 5:
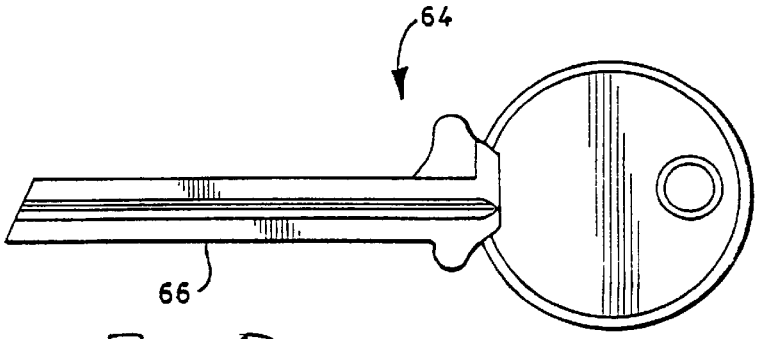
FIG. 5 shows a side view of an inserter.
Figure 6:
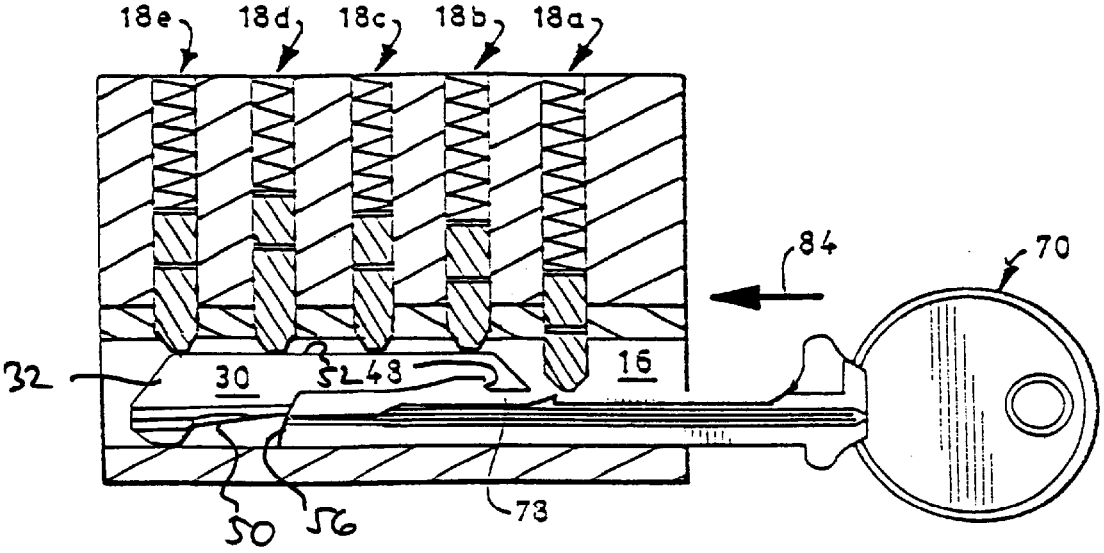
FIG. 6 shows a cross-sectional side view of the beginning of the extraction procedure.

The plug 30 is inserted into the keyway 16 by placing it in the entrance to the keyway 16 and pushing it into the keyway 16 until it stops. The plug 30 is initially placed and started into the keyway 16 manually. Once the plug 30 is inserted a small distance, to the point where a person's finger cannot push it in farther, a tool, such as the regular key or a key blank, must be used to push it in the rest of the way. Optionally, an inserter, shown in FIG. 5, is provided with the plug 30 and extractor 70. Preferably, the inserter 64 is similar to the extractor 70 with the exception that the inserter 64 lacks the hook 78 of the extractor 70. The inserter 64 is removed from the keyway 16 after the plug 30 is fully inserted. Because the inserter 64 does not have a hook, the plug 30 remains in the keyway 16.

Thus it has been shown and described a keyway plug which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A keyway plug for use with a tumbler lock having a keyway with an entrance into which a key is inserted and a plurality of tumblers biased into said keyway, said plurality of tumblers including an outermost tumbler adjacent to said entrance, innermost tumblers away from said entrance, and central tumblers therebetween, said keyway plug comprising:

(a) a plug having a tip and an arm extending therefrom to a free end remote from said tip, said arm having an upper edge in contact with said tumblers when installed in said keyway and having a lower edge opposite said upper edge, said lower edge having an inner portion adjacent to said tip and a hook;

(b) said plug being adapted to fit into said keyway such that said outermost tumbler extends fully into said keyway lower than said arm lower edge at said free end, preventing easy removal of said plug;

(c) an extractor including a grasping head and a finger, said finger having an upper edge with a hook and lifting portion remote from said grasping head;

(d) said lifting portion and inner portion adapted to push said plug tip against said innermost tumblers when said extractor finger is inserted into said keyway;

(e) said extractor hook adapted to mate with said plug hook to remove said plug from said keyway; and (f) said arm free end having a chamfer adapted to push said outermost tumbler upwardly out of said keyway when said plug is being removed from said keyway;

(g) whereby, when said extractor is inserted into said keyway, said lifting portion contacts said inner portion to push said plug tip against said innermost tumblers and said central tumblers push said arm against said extractor finger, tipping said free end below said outermost tumbler and causing said extractor hook and said plug hook to mate, and when said extractor is removed from said keyway, said mated hooks pull said plug from said keyway as said chamfer pushes said outermost tumbler from said keyway to allow said plug to be removed.

2. The keyway plug of claim 1 wherein said inner portion nearer said tip is farther from said arm upper edge than said inner portion nearer said arm free end and said lifting portion is approximately parallel to said finger upper edge.

3. The keyway plug of claim 1 wherein said inner portion is substantially parallel to said arm upper edge and said lifting portion rises away from said grasping head.

4. The keyway plug of claim 1 wherein said arm hook is formed by a notch in said arm lower edge and said extractor hook is formed by a protrusion on said finger upper edge.

5. The keyway plug of claim 1 wherein said arm hook is formed by a protrusion on said arm lower edge and said extractor hook is formed by a notch in said finger upper edge.

* * * * *